United States Patent [19]

Kitai

[11] Patent Number: 4,618,327

[45] Date of Patent: Oct. 21, 1986

[54] STEERING STRUCTURE FOR SHIP PROPELLING DEVICE

[75] Inventor: Toshio Kitai, Nagoya, Japan

[73] Assignee: Kabushiki Kaisha Kitai Tekkosho, Nagoya, Japan

[21] Appl. No.: 652,235

[22] Filed: Sep. 19, 1984

[30] Foreign Application Priority Data

Sep. 19, 1983 [JP] Japan ..... 58-172709

[51] Int. Cl.[4] ..... B63H 5/13

[52] U.S. Cl. ..... 440/53; 440/60

[58] Field of Search ..... 440/49, 53, 58, 60, 440/61, 63

[56] References Cited

U.S. PATENT DOCUMENTS

| | | | |
|---|---|---|---|
| 3,605,677 | 9/1971 | Bergstedt | 440/60 |
| 3,913,517 | 10/1975 | Lohse | 440/61 |
| 3,946,698 | 3/1976 | LaFollette | 440/60 |
| 4,416,637 | 11/1983 | Kashmerick | 440/53 |
| 4,432,737 | 2/1984 | Johansson | 440/60 |
| 4,493,656 | 1/1985 | Inoue | 440/53 |

*Primary Examiner*—Trygve M. Blix
*Assistant Examiner*—C. T. Bartz
*Attorney, Agent, or Firm*—Armstrong, Nikaido, Marmelstein & Kubovcik

[57] ABSTRACT

A steering structure for a ship propelling device includes: a support member for supporting the body of the ship propelling device on a hull; a universal joint for connecting between a drive shaft connected to a drive source and an input shaft of the ship propelling device; a vertically driving means adapted to cause the body to vertically pivot about a pivot shaft; and a turning driving means adapted to cause the body to pivot about an axis orthogonal to the axis of the pivot shaft. The vertically driving means and the body are connected together through a link mechanism. Such arrangement makes it possible to turn the whole of the ship propelling device independently of any vertical movement thereof, contributing to reduction of the production cost and a stable steering operation of the propelling device.

4 Claims, 5 Drawing Figures

STEERING STRUCTURE FOR SHIP PROPELLING DEVICE

BACKGROUND OF THE INVENTION

The present invention relates to a ship propelling device and, more particularly, to a steering device for a ship propelling device which is mounted outboard.

In conventional ship propelling devices of the type described above, a large-horsepower and high-torque propelling device has been composed of a non-turning portion which constitutes an upper portion of the ship propelling device and a turning portion which constitutes a lower portion thereof. In steering operation, only the turning portion is driven to turn from side to side. Therefore, as compared with a small-sized ship propelling device which is arranged such that the device is wholly turned when steering operation is effected, the above-described ship propelling device must unfavorably have a larger number of components and requires a higher production cost. Moreover, since this type of ship propelling device is formed to downwardly project from the bottom of a ship for the sake of its construction and function, it is inconveniently necessary to draw up the propelling device, when the ship passes through a shoal, in order to avoid any damage to the propelling device. Further, it is a well known fact that, when a ship runs glidingly as in the case of a high-speed boat, it is possible to effect an economical sailing and consequently to attain a reduction of energy consumption by adjusting the trim of the propelling device. It is desirable to conduct a stable steering operation even when the propelling device is vertically moved as described above.

SUMMARY OF THE INVENTION

In view of the above-described circumstances, it is a primary object of the present invention to provide a steering structure for a ship propelling device which is obtainable at a lower production cost as the result of a reduction in the number of components and which permits the propelling device to be stably steered, by enabling the ship propelling device as a whole to be properly turned independently of any vertical movement thereof.

To this end, according to the present invention, there is provided an arrangement wherein: a ship propelling device which is mounted outboard has a body supported on a support member secured to a hull through a horizontal pivot shaft so as to be pivotable about the pivot shaft as well as about an axis orthogonal to the axis of the pivot shaft; a drive shaft which is connected to a drive source mounted inboard and an input shaft of the ship propelling device are connected together through a universal joint; the body and a vertically driving means which is disposed inboard are connected together through a link mechanism in order to pivot the body about the pivot shaft; and the support member is provided with a turning driving means for pivoting the body about the axis orthogonal to the axis of the pivot shaft.

By the virtue of the above-described arrangement, the ship propelling device as a whole can be turned. Therefore, even in case of a large-horsepower and high-torque type ship propelling device, it is possible to decrease the number of components and consequently to reduce the production cost. Further, even when the ship propelling device is in its upwardly pivoted position, it is possible to conduct a stable steering operation and to attain an economical sailing.

The above and other objects, features and advantages of the present invention will become clear from the following detailed description of the preferred embodiment thereof, taken in conjunction with the accompanying drawings.

BRIEF DESCRIPTION OF THE DRAWINGS

The accompanying drawings in combination show one embodiment of the present invention in which.

DESCRIPTION OF THE PREFERRED EMBODIMENT

One embodiment of the present invention will be described hereinunder with reference to the accompanying drawings.

Figure 1:
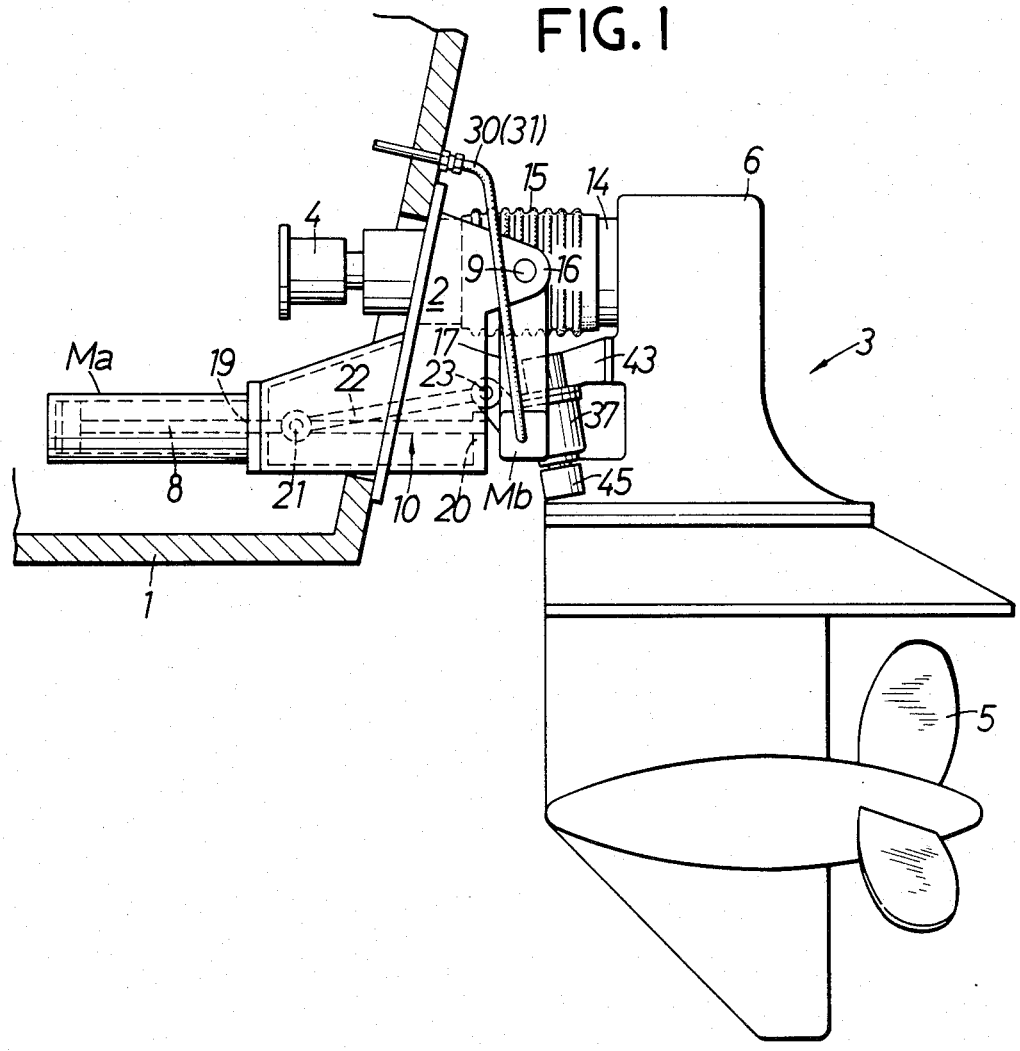
FIG. 1 is a partly-sectioned side elevational view of a ship propelling device in its mounted state.

Referring first to FIG. 1, a hull 1 has a support member 2 secured to a stern wall thereof. At the rear of the hull 1, a ship propelling device 3 is pivotally supported by the support member 2 through a horizontal pivot shaft 9. On the other hand, a drive shaft 4 connected to a drive source (not shown) provided inboard is received through the support member 2 and is connected to the ship propelling device 3. A propeller 5 of the ship propelling device 3 is rotated by the driving force transmitted through the drive shaft 4. More specifically, a transmission gear (not shown) is incorporated in a body 6 of the ship propelling device 3, and the driving force from the drive shaft 4 is transmitted to the propeller 5 through the transmission gear. Further, a vertically driving means Ma, such as a hydraulic cylinder, is disposed inboard. A linear motion of a piston rod 8 caused by the vertically driving means Ma is converted into a vertical motion of the ship propelling device 3 through a link mechanism 10. Moreover, the body 6 of the ship propelling device 3 is supported by the support member 2 in a manner to be pivotable about an axis which is orthogonal to the axis of the pivot shaft 9. The body 6 is driven to pivot by means of a hydraulic oil pressure supplied from a steering device (not shown) provided inboard.

Figure 2:
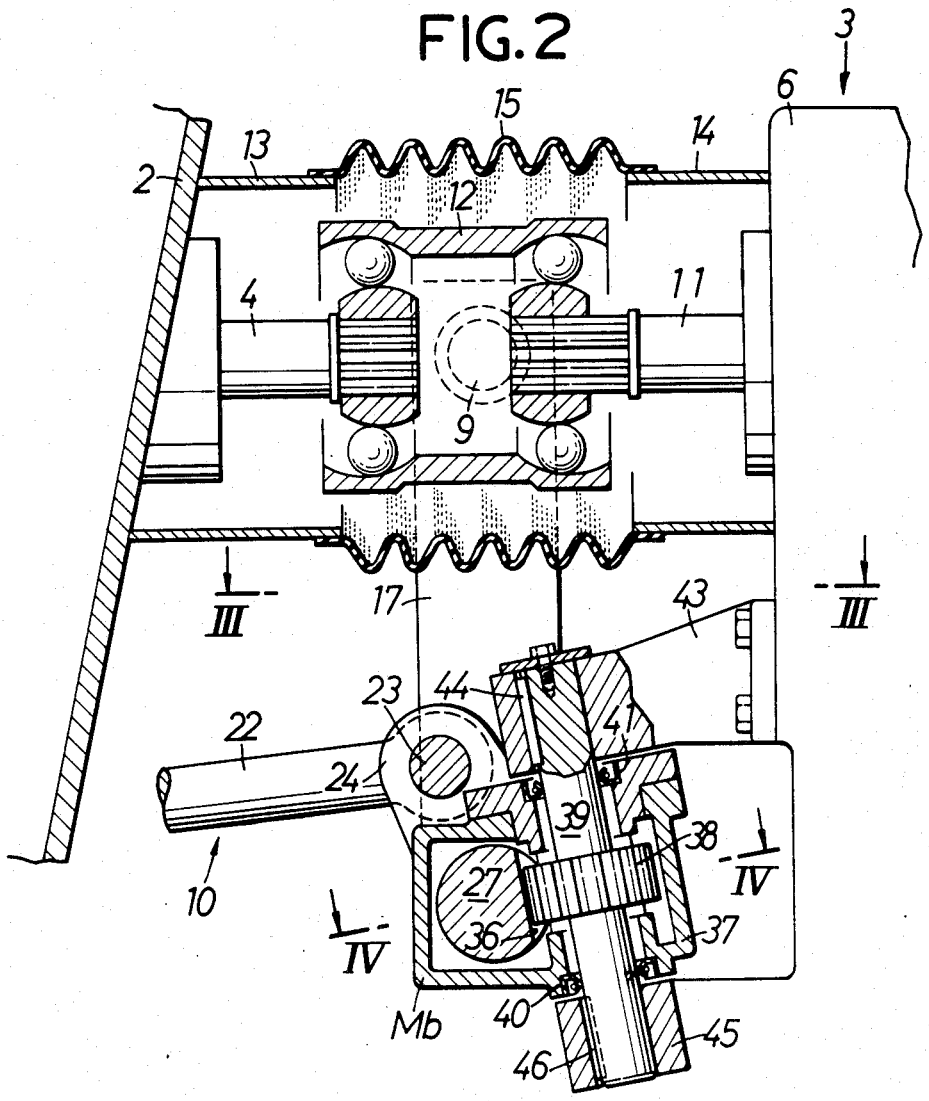
FIG. 2 is an enlarged sectional view of an essential part of FIG. 1.

Referring next to FIG. 2, the drive shaft 4 is watertightly received through the support member 2 to project therefrom rearwardly of the hull 1. One end portion of the drive shaft 4 and one end portion of an input shaft 11 projecting from the body 6 of the ship propelling device 3 are connected together through a universal joint, such as a ball joint 12 or a cruciform-joint. Accordingly, the drive shaft 4 and the input shaft 11 are able to effect power transmission through the ball joint 12 even in the state where the drive shaft 4 and the input shaft 11 form an angle at the joint therebetween. The support member 2 and the body 6 of the ship propelling device 3 are respectively provided with short tubular portions 13, 14 which respectively surround the output end of the drive shaft 4 and the input end of the input shaft 11. The respective ends of the short tubular portions 13, 14 are connected together through a flexible hermetically sealing member 15 which surrounds the ball joint 12.

Figure 3:
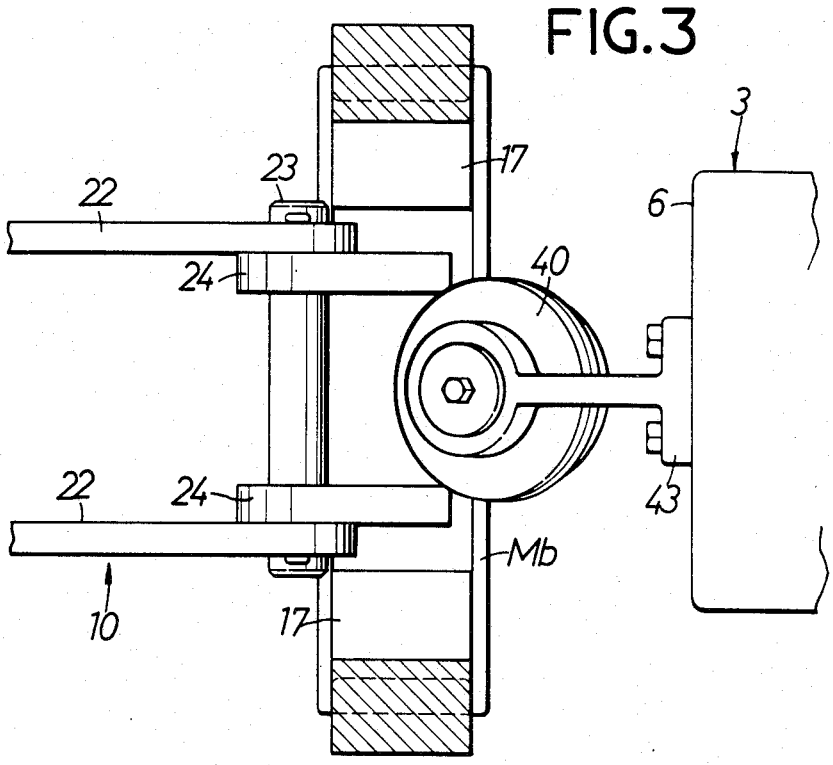
FIG. 3 is a sectional view taken along the line III—III of FIG. 2.

Referring also to FIG. 3, the support member 2 is provided with a pair of overhanging arms 16 respectively projecting at both sides of the hermetically sealing member 15. A pair of swing levers 17 are pivotally supported by the pair of overhanging arms 16 through the pivot shaft 9. These swing levers 17 extend downwardly in the radial direction of the shaft 9 and are integrally secured at their lower ends to a turning driving means Mb which is constituted by a hydraulic cylinder disposed in parallel to the shaft 9.

On the other hand, the piston rod 8 of the vertically driving means Ma is watertightly received through a bearing portion 19 of the support member 2 and is projected outwardly. Moreover, the support member 2 is integrally provided with a support portion 20 at an outward position spaced from the bearing portion 19. Thus, the piston rod 8 is supported by the support portion 20 so as to be movable in the axial direction thereof. Accordingly, the piston rod 8 is supported such that it is axially movable by both the bearing portion 19 and the support portion 20 at two positions separated from each other in the axial direction thereof.

A link mechanism 10 is interposed between the piston rod 8 and the turning driving means Mb. The link mechanism 10 is composed of: a pair of lifting rods 22 each having one end thereof connected to the piston rod 8, between the bearing portion 19 and the support portion 20, through a connecting pin 21 which is parallel to the shaft 9; and a pair of brackets 24 which are integrally provided on the turning driving means Mb and are respectively connected to the other ends of the lifting rods 22 through a pin 23 which is parallel to the connecting pin 21. By the link mechanism 10, the position of the connecting pin 21 is moved outwardly in the horizontal direction in response to the expanding drive of the vertically driving means Ma, and the turning driving means Mb is upwardly pushed by the lifting rods 22.

Figure 4:
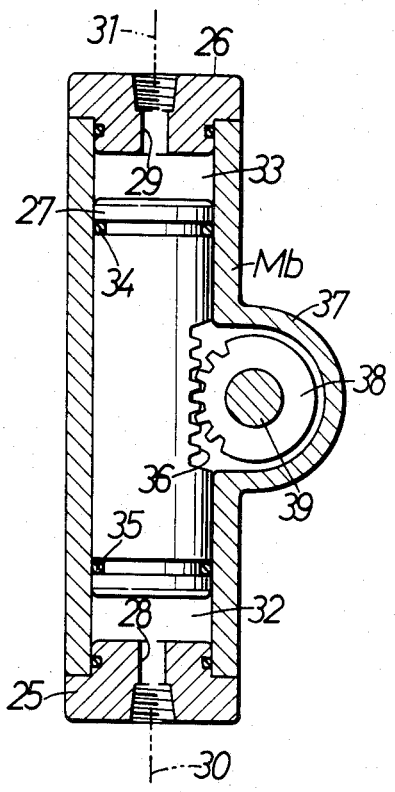
FIG. 4 is a sectional view taken along the line IV—IV of FIG. 2.

Referring also to FIG. 4, both ends of the turning driving means Mb are respectively closed with caps 25, 26. The turning driving means Mb is slidably fitted therein with a plunger 27. The caps 25, 26 are respectively formed with connecting bores 28, 29, to which are respectively connected hydraulic hoses 30, 31 for introducing the hydraulic oil pressure supplied from the steering device, not shown. Accordingly, from the hydraulic hoses 30, 31, the hydraulic oil pressure is supplied to hydraulic chambers 32, 33 which are respectively defined between one of the ends of the plunger 27 and the cap 25 and between the other end of the plunger 27 and the cap 26. Both the hydraulic chambers 32, 33 are sealed from each other by a pair of seal members 34, 35 which are respectively fitted on portions of the plunger 27 close to both ends thereof.

A rack 36 is cut in a portion of the plunger 27 which is in an approximately central part of the plunger 27 in the axial direction thereof. On the other hand, a gearbox 37 is integrally provided in an axially central portion of the turning driving means Mb. The gearbox 37 houses therein a pinion 38 which meshes with the rack 36. The pinion 38 is integrally provided on an intermediate portion of a steering shaft 39 which extends in a direction orthogonal to the axis of the shaft 9. The steering shaft 39 is received through the gearbox 37 and projects from the upper and lower portions of the latter through respective seal members 40, 41.

A support arm 43 extending above the gearbox 37 is integrally provided on the body 6 of the ship propelling device 3. To a distal end of the support arm 43 is connected the upper end of the steering shaft 39 by means of a key 44. On the other hand, below the gearbox 37, a steering shaft holder 45 is integrally secured to the body 6. The steering shaft holder 45 and the steering shaft 39 are connected together through a key 46. Accordingly, the body 6 of the ship propelling device 3 is supported by the gearbox 37, that is, by the swing lever 17 in such a manner that the gearbox 37 is clamped by both the support arm 43 and the steering shaft holder 45 from the upper and lower sides of the gearbox 37. Thus, the body 6 is swingable in response to a swing motion of the turning driving means Mb caused by the action of the link mechanism 10 and is turnable in response to a turning motion of the steering shaft 39.

The following is a description of the operation of the above-described embodiment.

In navigating the ship in a normal state, the piston rod 8 of the vertically driving means Ma is held in a contracted state so that the body 6 of the ship propelling device 3 is maintained in a vertical position. Under this state, the steering device is actuated to supply a hydraulic oil to one of the hydraulic chambers 32, 33 of the turning driving means Mb and to discharge the hydraulic oil from the other hydraulic chamber, whereby the plunger 27 is axially moved. In consequence, the steering shaft 39 is turned through the cooperation of the rack 36 and the pinion 38, causing the body 6 of the ship propelling device 3 to turn as a whole. Thus, it is possible to navigate the ship while changing the thrust direction.

Figure 5:
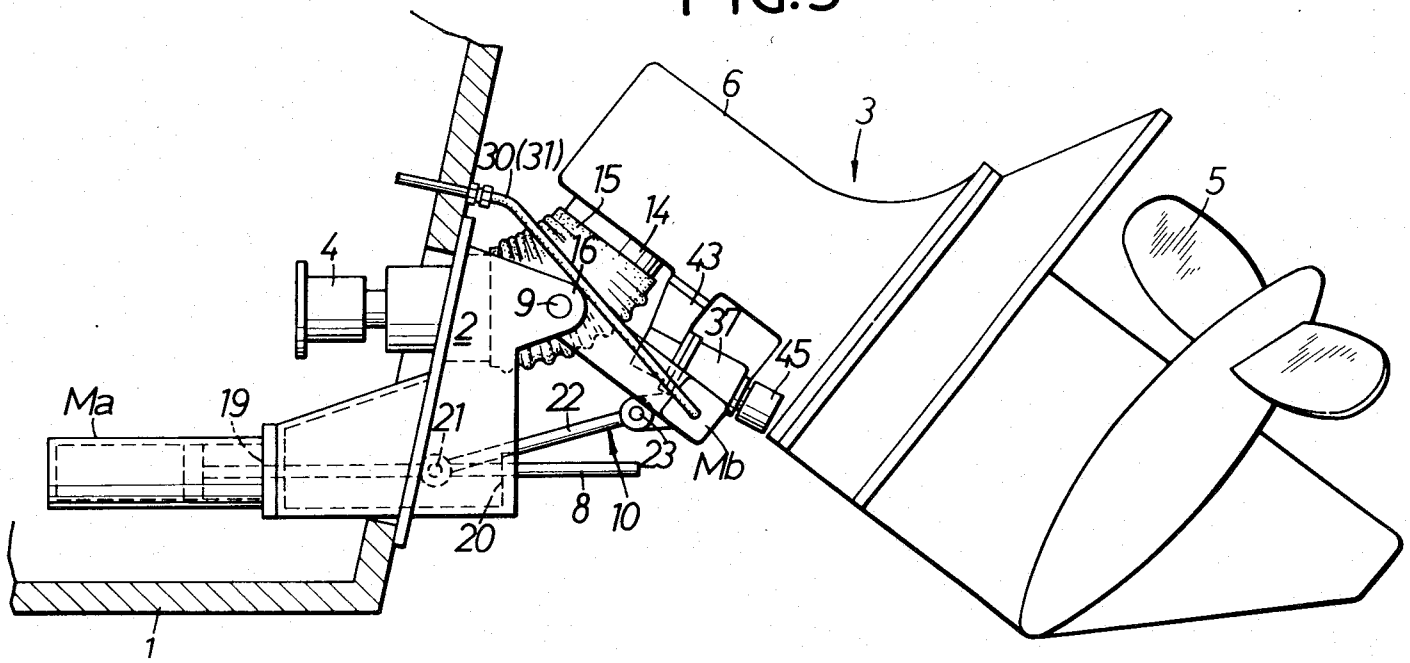
FIG. 5 is a partly-sectioned side elevational view corresponding to FIG. 1, showing the state wherein the ship propelling device is drawn up.

In the case of navigating the ship across a shoal or a water area where there may be obstacles, such as fishing nets, the vertically driving means Ma is actuated so as to expand the piston rod 8 as shown in FIG. 5. In consequence, the whole of the body 6 of the ship propelling device 3 is raised while pivoting about the shaft 9 in the counterclockwise direction as viewed in FIG. 5. Thus, it is possible to avoid any damage to the ship propelling device 3. Moreover, it is possible to set the upward pivoting angle of the ship propelling device 3 as desired by adjusting the expansion degree of the piston rod 8 by use of the vertically driving means Ma. Since the drive shaft 4 and the input shaft 11 are kept connected together through the ball joint 12 even when the ship propelling device 3 is thus vertically pivoted, the transmission of power from the drive shaft 4 to the input shaft 11 is effected in the same manner as that in the case of normal navigation, whereby it is possible to navigate the ship while maintaining the ship propelling device 3 in its upwardly pivoted position.

Further, when the supply of the hydraulic oil to the hydraulic chambers 32, 33 at both ends of the turning driving means Mb is controlled by the steering device in the state where the ship propelling device 3 is in its upwardly pivoted position, the steering shaft 39 is turned in the same manner as that in normal navigation. Consequently, the whole of the body 6 of the ship propelling device 3 is turned about the axis of the steering shaft 39. Thus, it is possible to steer the hull 1.

According to the above-described embodiment, the link mechanism 10 and the turning driving means Mb are disposed between the support member 2 and the body 6 of the ship propelling device 3 and therefore do not interfere with any obstacle. Accordingly, it is possible to smoothly effect the vertical movement and turning of the ship propelling device 3 during navigation.

What is claimed is:

1. A steering structure for a ship propelling device, comprising:

a support member which is secured to a hull and is adapted to support a body of the ship propelling device mounted outboard such that said body is wholly pivotable about a pivot shaft extending horizontally as well as about an axis orthogonal to an axis of said pivot shaft;

a universal joint which connects between a drive shaft connected to a drive source provided inboard and an input shaft of said ship propelling device;

a vertically driving means which is disposed inboard and is adapted to pivot the body of said ship propelling device about said pivot shaft;

a link mechanism which connects together said vertically driving means and said body of the ship propelling device and which allows the body to perform a vertical pivot motion in response to a horizontal linear motion of the driving means;

a hydraulically operated turning driving means which is provided on said support member and is operatively connected with said body so as to pivotally drive the whole body about the axis orthogonal to the axis of said pivot shaft;

a swing lever means pivotally supported on the support member through said pivot shaft and extending in a radial direction of the pivot shaft, said swing lever means having a free end to which is secured said turning driving means, said turning driving means including a box member for supporting a steering shaft integrally formed on the body for rotation around the axis orthogonal to the axis of the pivot shaft; and said body of the ship propelling device being provided with a pair of upper and lower support means projected frontwardly from a front surface of the body, said steering shaft being clamped and held between said support means against relative rotation.

2. A steering structure according to claim 1, wherein said link mechanism comprises a lifting rod having first and second ends, said first end of the lifting rod being connected to a movable rod of the vertically driving means in a manner pivotable around an axis parallel with the axis of the pivot shaft while the second end being connected to the turning driving means for pivot motion around an axis parallel with the axis of the pivot shaft.

3. A steering structure according to claim 1, wherein said turning driving means comprises a plunger which is movable in the axial direction of the pivot shaft, said plunger being provided with a rack which is in mesh with a pinion formed on said steering shaft.

4. A steering structure for a ship propelling device, comprising:

a support member fixedly secured to a hull;

a swing lever means supported by said support member via a horizontally extending pivot shaft in a manner pivotable around an axis of said pivot shaft, said swing lever means supporting an outboard mounted body of the ship propelling device in a manner pivotable around an axis orthogonal to the axis of the pivot shaft;

a vertically driving means disposed inboard and operatively connected with the swing lever means, said vertically driving means being operable to vertically pivot the swing lever means and the whole body of the ship propelling device around the pivot shaft;

a turning driving means integrally formed on said swing lever means and associated with said body for rotating said body wholly around the axis orthogonal to the axis of the pivot shaft;

said body of the ship propelling device having a steering shaft while being provided with a pair of upper and lower support means projected frontwardly from a front face of the body, said steering shaft being clamped and held between said upper and lower support means against relative rotation; and whereby said turning driving means is rotatable together with said swing lever means around the pivot shaft during operation of the vertically driving means and is adapted, in its vertically rotated position, to rotate the body around the axis orthogonal to the axis of the pivot shaft independently from the swing lever means and the support member.

* * * * *